United States Patent [19]

Poole

[11] 4,177,958

[45] Dec. 11, 1979

[54] TOILET PAPER SERVICE PEDESTAL

[76] Inventor: Judith A. Poole, 746-8th Ave. S., S. Saint Paul, Minn. 55075

[21] Appl. No.: 915,928

[22] Filed: Jun. 15, 1978

[51] Int. Cl.[2] ..... A47K 10/22; A47K 10/32

[52] U.S. Cl. ..... 242/55.42; 312/39

[58] Field of Search ..... 242/55.3, 55.53, 55.42, 242/55.54; 312/39, 40, 41

[56] References Cited

U.S. PATENT DOCUMENTS

| | | | |
|---|---|---|---|
| 2,564,539 | 8/1951 | Lucan | 242/55.3 |
| 3,316,040 | 4/1967 | McGann | 242/55.3 |
| 3,413,049 | 11/1968 | Smay | 242/55.53 X |
| 3,552,669 | 1/1971 | Earnest | 242/55.3 |
| 3,843,071 | 10/1974 | Graham | 242/55.53 |

FOREIGN PATENT DOCUMENTS

| | | | |
|---|---|---|---|
| 623434 | 7/1961 | Canada | 242/55.53 |
| 2210732 | 9/1962 | Fed. Rep. of Germany | 242/55.3 |

*Primary Examiner*—George F. Mautz

*Attorney, Agent, or Firm*—Frederick A. Fleming

[57] ABSTRACT

For dispensing rolled toilet paper, the pedestal is free standing on a weighted base, to be placed at convenient reach to a toilet. From a slot in a cover at its head, the pedestal presents the pennant from a roll of toilet paper held on a spindle. Lengths of toilet paper may be torn off from the pennant as wanted. In its body the pedestal contains extra rolls of toilet paper, readily accessible to replenish the roll at the head when it is emptied.

2 Claims, 3 Drawing Figures

TOILET PAPER SERVICE PEDESTAL

BACKGROUND OF THE INVENTION

1. Field of the Invention

The invention is within the Winding and Reeling classification, Class 242, and more particularly, those subclasses including and subordinate to Subclass 55.2, reels or rolls and their holders, especially Subclasses 55.42 and 55.54 in which rolls are mounted on spindles, the spindles being vertically positioned.

2. Prior Art Statement

A search revealed the following U.S. Patents which were believed to be most closely relevant to my disclosure:

U.S. Pat. No. 1,224,106 Good 4/24/1917;
U.S. Pat. No. 2,327,816 Olson 8/24/1943;
U.S. Pat. No. 3,370,805 Barbee 2/27/1968;
U.S. Pat. No. 3,407,980 Addison 10/29/1968;
U.S. Pat. No. 3,622,010 Renelt 11/23/1971.

All of these patents disclose toilet paper holders having spindles mounted vertically. All are attached to the wall, except for that of Renelt, which is a decorated "plumber's helper" to hold a spare roll of toilet paper at access to the toilet but which is not a dispenser itself. Barbee's dispenser stacks an extra roll of toilet paper on a telescoping extension of the primary roll. Olson's dispenser features a cylindrical cover with a slot having a serrated edge for tearing the paper. The disclosures of Good and Addison show individual means for mounting a vertical spindle in a device for attachment to the wall.

The disclosures do not reveal the combination of elements which is the subject matter of my invention, a free-standing pedestal having a dispensing supply of toilet paper spindled vertically at its head and a reserve supply of rolls of toilet paper in its body.

3. The Problem

Bathrooms and "half-baths" of every size and arrangement may be seen in homes today. It is not at all uncommon to find that there is no convenient place to mount the usual wall fixture dispenser.

More often than not, there is no place within reach of the toilet for storage of that spare roll of toilet paper which is so necessary when it is discovered too late that the supply from the dispenser is exhausted.

Finally, interior decorating has progressed to such a fine art in homes today, the bathroom not excepted, and utilitarian objects which lend themselves to artistic rendition are a welcomed addition.

SUMMARY OF THE INVENTION

My invention is a toilet paper service pedestal, being a substantially columnar body with a weighted base, a space within the body for storage of three or more spare rolls of toilet paper, a platform at the head of the body to support vertically a roll of toilet paper for rotation on a spindle, and a cap to cover the head of the column and conceal the roll of toilet paper, except for the web of paper extending like a pennant from a slot in the cap.

My toilet paper service pedestal serves the long-standing need for a handy supply of toilet paper for those bathrooms and similar lavatory facilities in which there is no suitable place for mounting a wall dispenser. Equally important, my toilet paper service pedestal provides space to store a supply of spare rolls of toilet paper, to rescue from embarrassment the party who discovers that the dispensing supply is exhausted. From the esthetics standpoint, my toilet paper service pedestal affords a vehicle for artistic rendition, to please the tastes of the owner. In addition to being amenable to decoration by pattern and floral additions, the pedestal itself may be rendered in any of the classic forms of column or similar statuary and may also serve as the platform base for decorative or utilitarian objects.

DESCRIPTION OF THE PREFERRED EMBODIMENT

Figure 1:
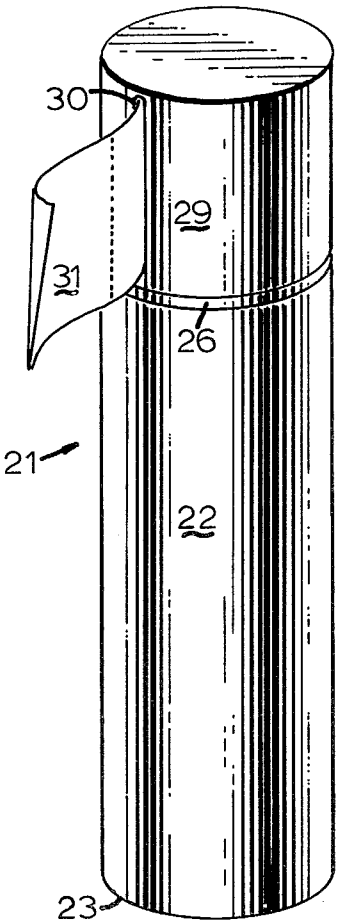
FIG. 1 is an overall perspective view of the toilet paper service pedestal showing the full assembly and with a pennant of toilet paper extending from the head.
Figure 2:
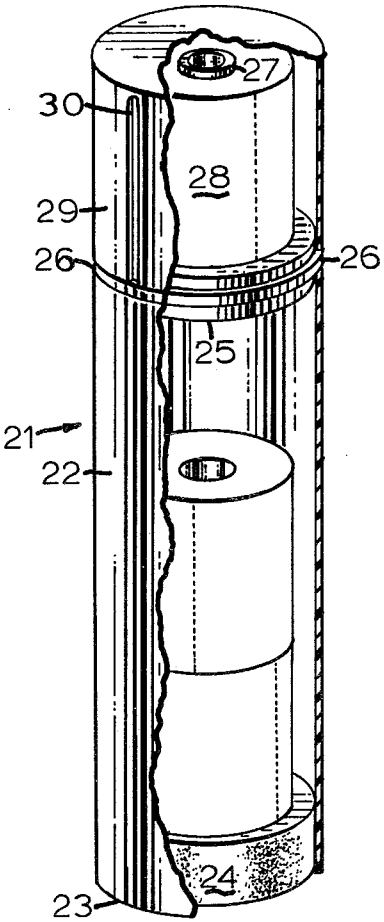
FIG. 2 is an overall perspective view, with parts broken away to reveal the dispensing and storage compartments within.
Figure 3:
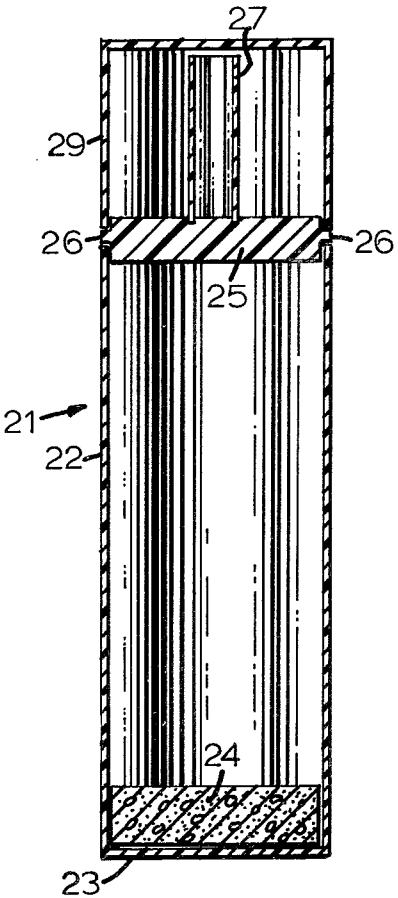
FIG. 3 is a side elevation of the longitudinal mid section of the pedestal.

My toilet paper service pedestal 21 (cf. FIGS. 1-3) includes a hollow columnar body 22, open at the top and closed at the bottom 23 which serves as the base or foot for situating the pedestal on the floor. A dense mass, the weight 24 is contained in the bottom of the body 22 and serves to stabilize the pedestal against tipping over. The weight 24 may be of lead, iron, concrete, or dense ceramic material and it is shaped to conform to the interior space of the body, here shown cylindrical. The remaining space within the body 22 is sufficient to contain three or four rolls of toilet paper, as elected. Space for three such reserve rolls is illustrated in the figures.

At the head of the body 22 is the access port or platform 25 which is fixed removably upon the top of the body by conformation fit by suitable means such as illustrated by the flange 26.

A spindle 27 is fixed centrally and vertically in the platform 25 and is dimensioned to accommodate a toll of toilet paper 28 placed thereupon, permitting free rotation thereof.

A cap 29 covers the head of pedestal 21, seating on the platform 25 and positioned by means such as the flange 26. A vertical slot 30 in the side of the cap 29 is of length to permit the free travel of the width of the toilet paper web 31 therethrough.

Toilet paper is commonly purchased in packages of four rolls to the package, three of which may be placed in the storage compartment in the body 22 and the fourth of which may be placed in the dispensing position on the spindle 27. To initiate the toilet paper service pedestal 21, the cap 29 and platform 25 are removed and three rolls are placed in the storage compartment as suggested in FIG. 2 (which actually shows just two rolls). The platform 25 is then replaced at the head of the body 22 and the fourth roll is placed on the spindle 27. The cap 29 is then placed over the head, threading the web 31 of the toilet paper through the slot 30 and allowing a pennant of one or two sheets to hang free therefrom. To dispense toilet paper, the web 31 is pulled out with one hand until the desired length is unrolled. With the other hand, the web near the sot 30 is arrested and the length is torn off, usually at the perforations of manufacture which mark the sheets. Should the pennant be lost within the cap 29, it is easily retrieved by lifting the cap 29 and rethreading the web 31 through the slot 30.

When the dispensing supply roll 28 (FIG. 2) is used up, the cap 29 is removed, the paper core of the spent roll is discarded from the spindle 27 and the platform 25 is lifted off of the head of the body 22 to give access to a spare roll stacked within, lifting it out by hand.

I have illustrated and discussed my toilet paper service pedestal as it is fabricated chiefly of plastic, but the construction is one that may be easily made from sheet metal, using the usual techniques of the tinsmith as seen in cannisters and the like. Furthermore, the toilet paper service pedestal may be made in cast plaster or ceramic, to render more artistic and luxurious models.

Other embodiments of my invention other than the preferred embodiment as disclosed above also come within the contemplation of my disclosure, for example, a more utilitarian form of the invention, without the cap 29.

I claim:

1. A toilet paper service pedestal, comprising the following combination of elements:

a hollow, elongate body having an open head end and a closed foot end, adapted to stand upright on the foot end;

a weight, being a dense mass adapted to fit within the elongate body within its foot, to stabilize the elongate body from upset; wherein the space remaining within the body is sufficient to accommodate three or more rolls of toilet paper;

a platform, adapted to attach at the head of the elongate body, to support a roll of toilet paper at the head;

a spindle orientated vertically and fixed centrally on the platform, to be accommodated by the hollow core of the roll of toilet paper, to hold the roll of toilet paper for rotation but against translocation on the platform;

a cap, to fit on the head of the pedestal at the platform, to cover the roll of tolet paper from view; and a slot in the cap, to afford exit for the web of toilet paper, the slot extending from the lower margin of the cap vertically on the lateral surface of the cap for a distance at least equal to the width of the toilet paper web; wherein an additional supply of rolls may be stored within the body of the pedestal, to serve as a reserve supply, to replenish the dispensing roll on the spindle, by lifting off the platform and taking out the reserve roll.

2. A toilet paper service pedestal comprising a hollow elongate body standing vertically on a base end in contact with the floor and being free to be moved laterally on the floor, a dense mass in the base end to stabilize the pedestal against toppling over, with a removable platform on the head end of the pedestal with a vertical spindle on the platform to hold a roll of toilet paper for dispensing short lengths of paper and with access through the removable platform for introducing and removing rolls of toilet paper to and from the hollow body.

* * * * *